US005267355A

United States Patent [19]

Landman

[11] Patent Number: 5,267,355

[45] Date of Patent: Dec. 7, 1993

[54] PORTABLE TOILET SEAT

[76] Inventor: Michael Landman, 235 SW. Le Jeune Rd., Miami, Fla. 33134

[21] Appl. No.: 806,223

[22] Filed: Dec. 13, 1991

[51] Int. Cl.[5] ..... A47K 13/06

[52] U.S. Cl. ..... 4/237; 4/239

[58] Field of Search ..... 4/234, 237, 245.1-245.7, 4/235, 239

[56] References Cited

U.S. PATENT DOCUMENTS

| | | | |
|---|---|---|---|
| 396,803 | 1/1889 | Breher | 4/239 |
| 747,960 | 12/1903 | Franken | 4/245.1 |
| 2,443,068 | 6/1948 | Dahle | 4/239 |
| 2,457,726 | 12/1948 | Richards | 4/239 |
| 4,525,880 | 7/1985 | Bass | 4/239 |
| 5,005,223 | 4/1991 | Greenwood | 4/245.7 X |

*Primary Examiner*—Charles E. Phillips

*Attorney, Agent, or Firm*—J. Sanchelima

[57] ABSTRACT

A portable toilet seat to be removably mounted on toilet installations that include an upper rim surface. The seat has two arched seat members, each having an upper half and a lower half that are securely mounted to each other, and each one of said arched seat members has an internal longitudinal channel. Two pairs of hingedly mounted arm members slidably housed inside the longitudinal channel so that when the two pairs of hingedly mounted arm members slide out and the arm members can be coaxially disposed when extended. The portable toilet seat adopts a substantially circular configuration that cooperatively aligns with the toilet rim surface. Locking mechanisms are provided to the hingedly mounted arm members so that they stay in place when housed within said arched seat members.

5 Claims, 3 Drawing Sheets

PORTABLE TOILET SEAT

BACKGROUND OF THE INVENTION

1. Field of the Invention.

The present invention relates to a portable toilet seat, and more particularly, to such portable toilet seats that are foldable and can be rarely stored in a volumetrically efficient manner.

The transmission of diseases through toilet seats is on the increase. There are a number of devices, primarily made out of paper, that attempt to resolve this problem. Even in large buildings where people share the same sanitary facilities problems have been reported because these paper covers are typically not very reliable and susceptible to rupture. Also the sanitary facilities also periodically run out of these covers and/or discontinue its usage.

2. Description of the Related Art.

The transmission of diseases through toilet seats is on the increase. There are a number of devices, primarily made out of paper, that attempt to resolve this problem. Even in large buildings where people share the same sanitary facilities problems have been reported because these paper covers are typically not very reliable and susceptible to rupture. Also the sanitary facilities periodically run out of these covers and/or discontinue its usage.

SUMMARY OF THE INVENTION

It is one of the main objects of the present invention to provide a toilet seat cover that can be readily disassembled and folded in a compact and volumetrically efficient manner so it can be easily carried and/or stored by the user.

It is another object of the present invention to provide such a portable seat cover that can be readily washed without loosing its functionality.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
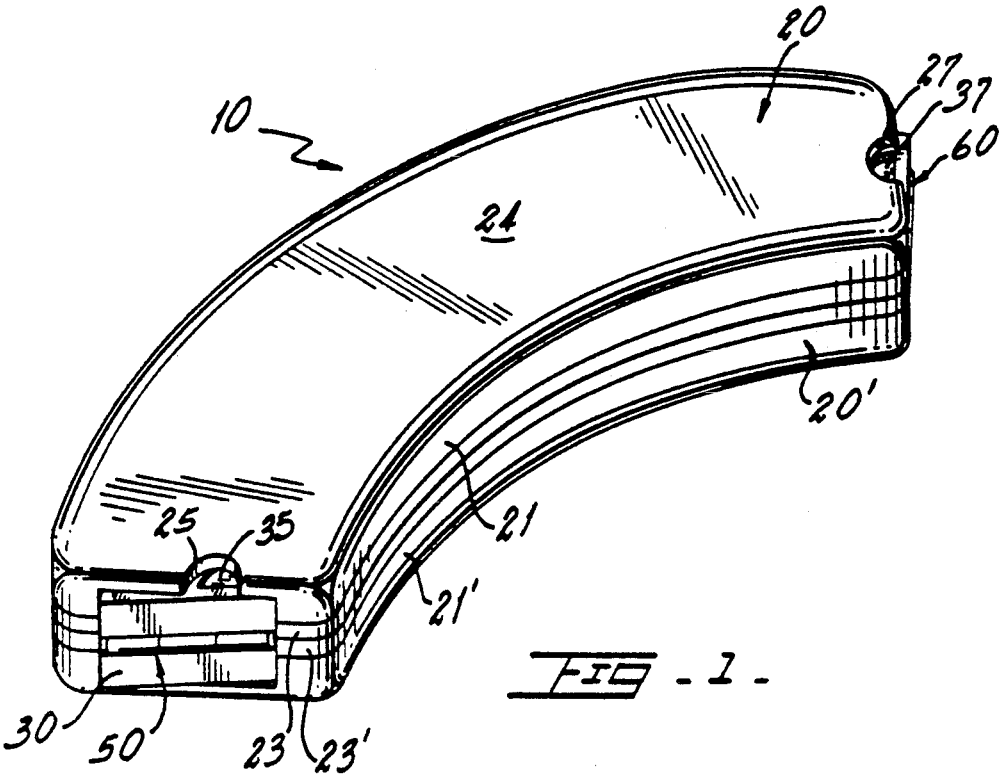
FIG. 1 represents the present portable seat cover in it's folded and compact state.
Figure 2:
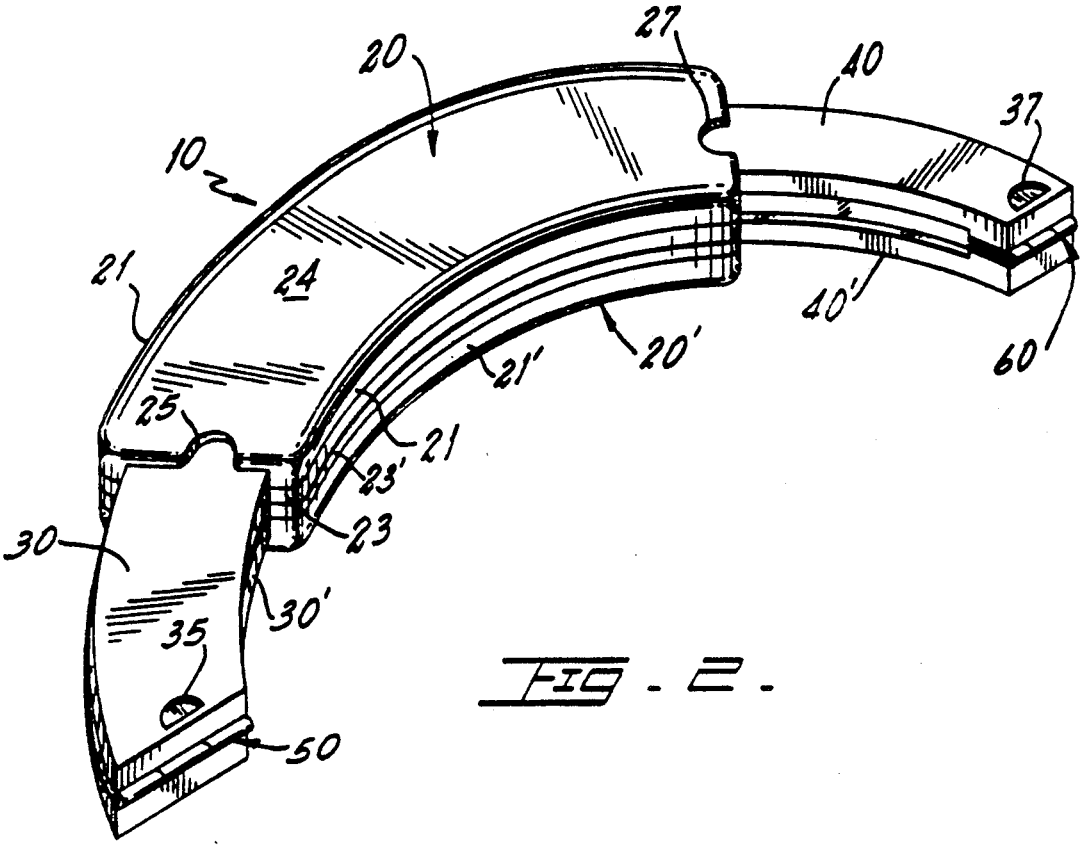
FIG. 2 shows the portable seat cover represented in FIG. 1 with the internal hingedly mounted arm members fully extended outwardly.

Referring now to FIG. 1, where the present invention is generally referred to with numeral 10, it can be observed that it folds into a compact size that can be easily stored in a purse or any other reduced storage area. Arched seat members 20 and 20' are symmetrically disposed abutting each other. Upper surface 24 is typically a smooth washable surface that comes in contact with the user. In FIG. 2, hingedly mounted arm members 30; 30'; 40 and 40' are shown extended out of the housing formed by seat members 20 and 20' and showing hinge assemblies 50 and 60. Cutouts 25 and 27 are cooperatively positioned at one end of upper half 21 of member 20 (it could also be on upper half 21' of member 20') thereby permitting a user to easily reach notches 35 and 37 on the respective ends of hingedly mounted arm members 30 and 40 (which could also have been members 30' and 40'). Finally, in FIG. 3, portable toilet seat assembly 10 is shown in its completely distended position and it's designed with cooperative dimensions for the typical toilet installations.

Figure 3A:
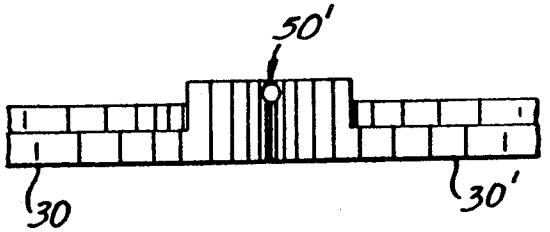
FIG. 3A shows a detail view of the section where the arms are hingedly mounted to each other through a reduction of material at one point that implements the function of a hinge assembly.
Figure 3B:
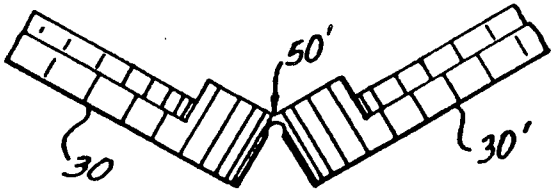
FIG. 3B represents the same section illustrated in FIG. 3A but wherein the arm members are not coaxially disposed.

Hinge assembly 50 and 60 can be implemented, alternatively, as shown in FIGS. 3A and 3B. This approach is more suitable for plastic production. The functions of the hinge assembly is accomplished with a reduction of the material at a predetermined point 50' that permits the flexing of arm members 30 and 30' or 40 and 40'.

Figure 3:
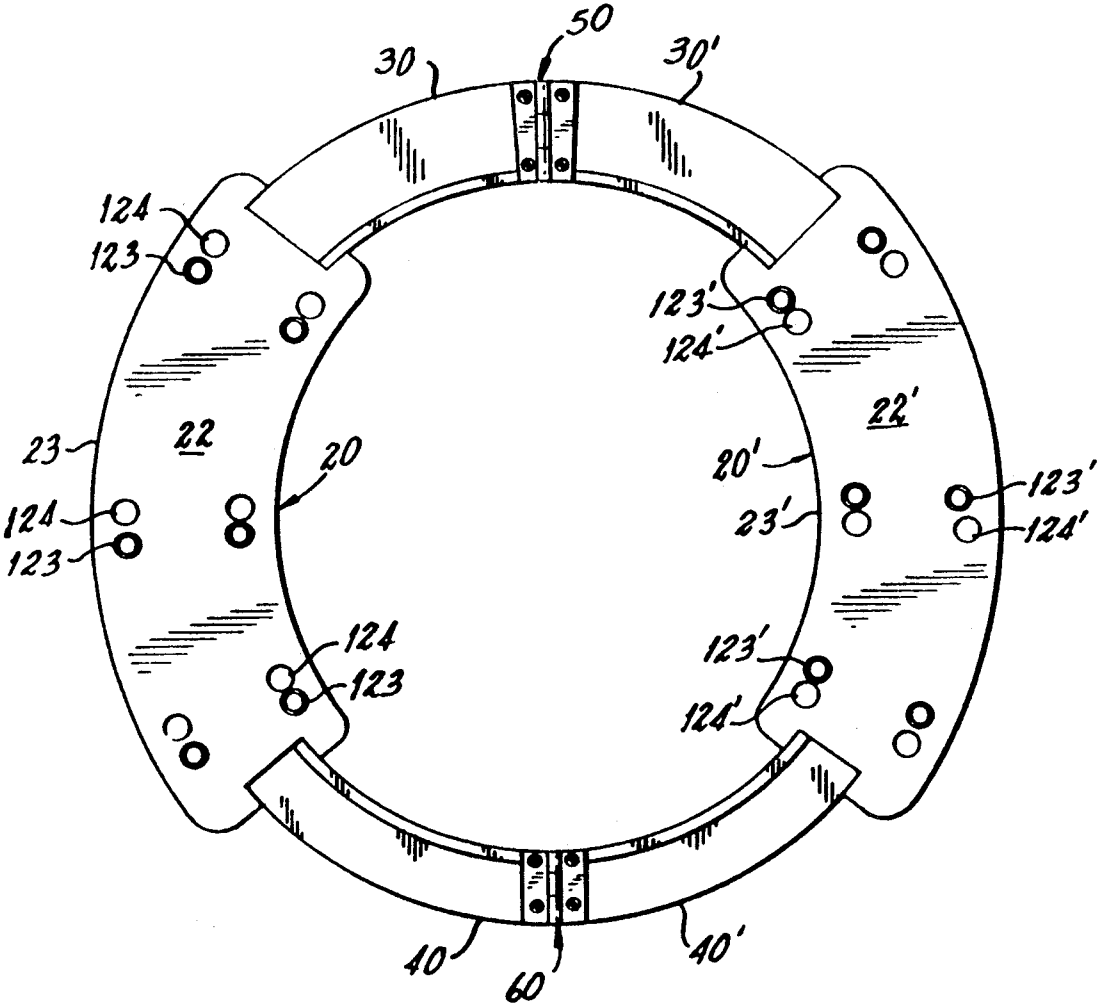
FIG. 3 illustrates a top view of the portable seat cover fully extended and unfolded.

FIG. 3 shows bottom surfaces 22 and 22' that come in contact with the toilet seat where the present invention is used. Bottom halves 23 and 23' include several spacer members 123 and 123' that protrude perpendicularly away from bottom surfaces 22 and 22'. Spacer members 123 and 123' are preferably made out of a high friction material, such as rubber, that prevents portable seat assembly 10 from sliding on the upper rim surface of the toilet installation where it is being used. Cooperating receiving openings 124 and 124' permit the complete housing of spacer members 123 and 123' when seat members 20 and 20' are folded toward each other for storage.

FIGS. 3A and 3B show how the hinge function can be implemented using a flexible plastic material with a sufficiently reduced portion to permit the necessary flexibility.

Figure 4B:
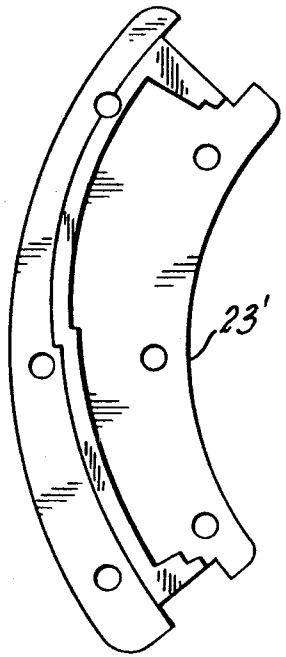
FIG. 4B shows the other bottom half of the portable seat assembly.
Figure 4:
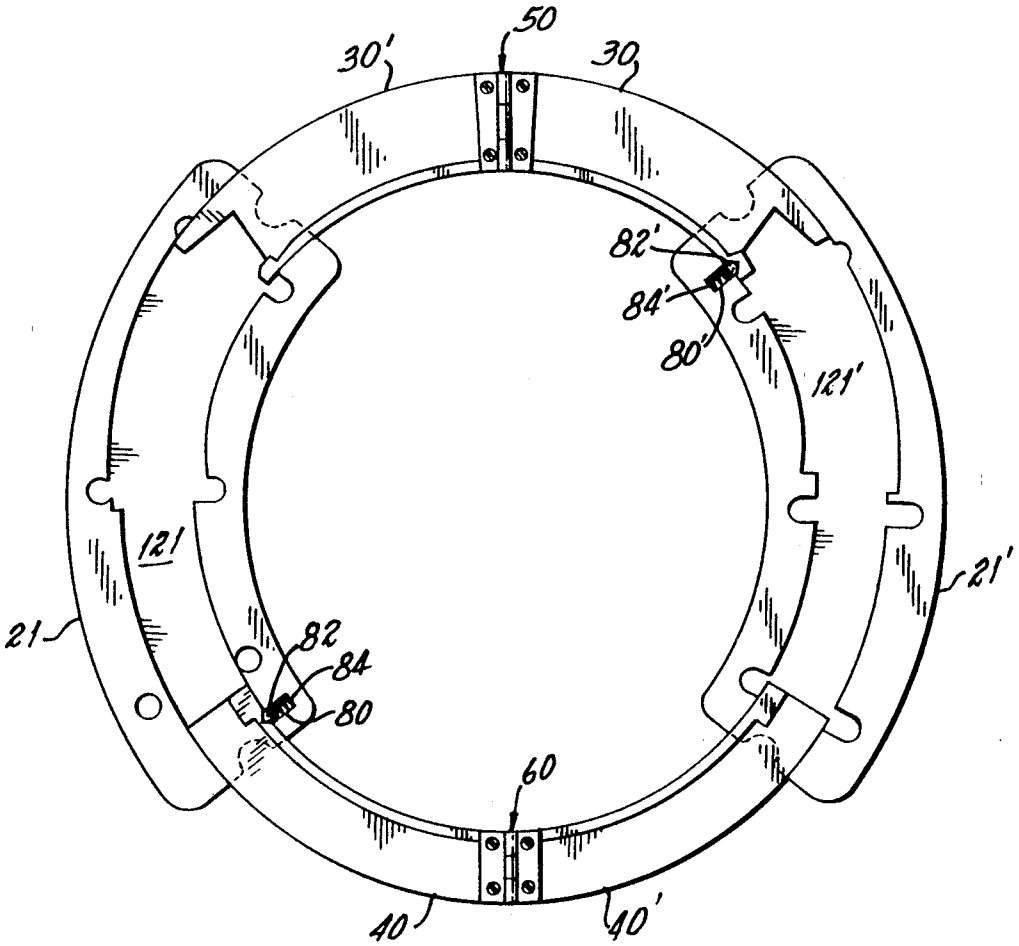
FIG. 4 is a representation of the bottom view of the portable seat cover unfolded and extended.
Figure 4A:
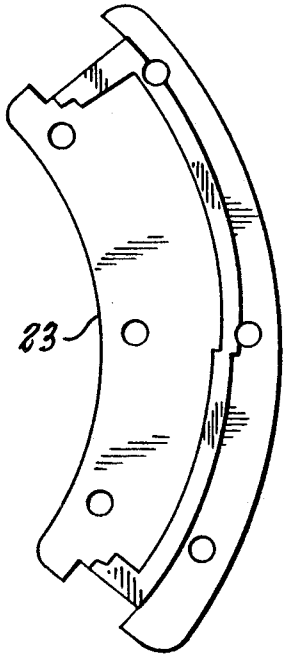
FIG. 4A illustrates the inner bottom view of one of the bottom halves of the toilet seat assembly.

In FIG. 4, upper halves 21 and 21' of members 20 and 20' are shown connected to each other through fully extended hingedly mounted arm members 30, 30', 40, and 40'. FIGS. 4A and 4B show lower halves 23 and 23' separated from their respective upper halves in FIG. 4 so that the internal configuration of the preferred embodiments disclosed herein can be observed. Internal channel 121 and 121' are shown in FIG. 4 in which hingedly mounted arms 30; 30'; 40 and 40' are slidably received. Locking mechanism 80 and 80' coact with arm members 30 and 40', in the preferred embodiment, to insure that the latter are kept inside members 20 and 20' and that they do not accidentally slide out. In this preferred embodiment, locking mechanisms 80 the 80' have been implemented with spring loaded ball assemblies 82 and 82' that are housed within cavities 84 and 84' in upper halves 21 and 21'.

The foregoing description conveys the best understanding of the objectives and advantages of the present invention. Different embodiments may be made of the invention concept of this invention. It is to be understood that all matter disclosed herein is to be interpreted merely as illustrative, and not in a limiting sense.

What is claimed is:

1. A portable toilet seat to be removably mounted on toilet installations that include an upper rim surface, comprising:

A. first and second arcuate seat members, each having a first and a second end and a top and bottom surface, each one of said seat members including an internal longitudinal channel extending inwardly from said first and second ends; and B. first and second arm members, each of said first and second arm members consisting of two arcuate arms, each arm having first and second ends, and said two arms being hingedly attached to each other at said first ends, the second end of one arm of the first arm member being telescopically received in the channel of the first end of said first arcuate seat member, the second end of the other arm of said first arm member being telescopically slidably received in the first end of said second arcuate seat member, and the second end of one arm of the second arm member being telescopically received in the channel of the second end of said first arcuate seat member, the second end of the other arm of said second arm member being telescopically slidably received in the second end of said second arched seat member whereby with the bottom surfaces of said first and second arcuate members superimposed on each other said first and second arm members may be telescopically housed in said longitudinal channel to provide a compact mode of said seat and from such position said first and second arm members may be telescopically extended from said arcuate members and by pivoting said two arms about said hinged attachment said arcuate members can be positioned such that said bottom surfaces are generally coplanar and said seat members are positioned generally on opposite sides of a circle so as to be capable of supporting a user on a toilet.

2. The portable toilet seat set forth in claim 1, wherein said bottom surfaces include a plurality of spacer means mounted thereon and said spacer means separate said bottom surfaces from said rim surface of said toilet installation.

3. The portable toilet seat set forth in claim 2 said each one of said pairs of hingedly mounted arm members includes locking means for releasably keeping said pairs of hingedly mounted arm members in place inside said arched seat members.

4. The portable toilet seat set forth in claim 3 wherein said hingedly mounted arms are made out of a flexible plastic material that includes a portion with sufficiently reduced thickness to provide the necessary flexibility to perform the hinged function.

5. The portable toilet seat set forth in claim 2 wherein each of said bottom surfaces includes a plurality of openings that cooperatively receive said spacer means of an opposed bottom surface seat is folded and said bottom surfaces are in abutting relation with respect to each other.

* * * * *